United States Patent [19]

Kausträter et al.

[11] Patent Number: 4,919,038

[45] Date of Patent: Apr. 24, 1990

[54] ARMOURED CAR

[75] Inventors: Gert Kausträter, Augsburg; Norbert Müller, Friedberg, both of Fed. Rep. of Germany

[73] Assignee: Kuka Wehrtechnik GmbH, Augsburg, Fed. Rep. of Germany

[21] Appl. No.: 215,540

[22] Filed: Jul. 6, 1988

[30] Foreign Application Priority Data

Jul. 7, 1987 [DE] Fed. Rep. of Germany ..... 3722353

[51] Int. Cl.[5] ..... F41F 9/06; F41H 7/02

[52] U.S. Cl. ..... 89/46; 89/36.13

[58] Field of Search ..... 89/36.13, 46, 45, 47, 89/34

[56] References Cited

U.S. PATENT DOCUMENTS

| | | | |
|---|---|---|---|
| 2,456,620 | 12/1948 | Chadwick et al. | 89/46 |
| 4,388,854 | 6/1983 | Dabrowski et al. | 89/46 |
| 4,391,179 | 7/1983 | Tidström | 89/46 |
| 4,481,862 | 11/1984 | Wiethoff et al. | 89/46 |
| 4,495,853 | 1/1985 | Gottwaldt | 89/46 |
| 4,632,011 | 12/1986 | Metz | 89/36.13 |
| 4,700,609 | 10/1987 | Wiethoff et al. | 89/46 |

*Primary Examiner*—David H. Brown

*Attorney, Agent, or Firm*—Antonelli, Terry & Wands

[57] ABSTRACT

In an armoured vehicle with a turret, a weapon mounted therein and a magazine housed in the armoured vehicle and receiving large calibre ammunition in the upright position in a concentric arrangement with respect to the turret rotation axis is arranged a loader, which has a loading arm gripping the ammunition on the magazine and raising it into an aligned position with the weapon bore axis, i.e. the loading position. The loader is arranged on a ring mount positioned roughly below the weapon breech block on the turret platform and whose rotation axis coincides with that of the turret and has a multilever guide supported on the ring mount and movable in a vertical plane, which raises the loading arm with the upright ammunition in a steep movement path and only towards the end of the movement path swings into the loading position.

33 Claims, 8 Drawing Sheets

VI
VI
II
II
1
2
3
4
5
6
7
8
9
10
13
14
15
16
20
21
22
24
25
26
27
28
29
30
31
32
33
34
35
37
38
39
40
41
42
43
44
45
46
47
48
49
50
51
53
54
56
57
58
59
60

ARMOURED CAR

BACKGROUND OF THE INVENTION

The invention relates to an armoured car with a turret, a weapon mounted therein, a magazine housed in the car and receiving large calibre or bore ammunition standing upright in a concentric arrangement to the rotation axis of the turret and a loader having a loading arm gripping the ammunition at the magazine and raising it into an aligned position with the bore axis of the weapon, i.e. the loading position.

For the loading of large calibre tank weapons automatically operating loaders are already known, which have mainly resulted from the need for a high firing speed, but also for facilitating the manual work of loading, for example, the loaders comprise a type of belt magazine for a large number of bullets positioned level with the weapon bearing and spaced therefrom in the rear part of the sighting hood, i.e. outside the actual vehicle. The individual magazine receptacles can be brought into a loading position aligned with the weapon bore axis. The distance between the weapon bearing or the weapon breech block and the magazine is bridged by a loading bridge, which can be swung out so as to also permit manual loading from the bottom. These automatic loaders, as a result of their only limited reception capacity, require frequent reequipping with ammunition or rearming and this is generally only manually possible. In addition, access to the magazine in the rear part of the turret is very difficult for reequipping with ammunition.

In, for example, U.S. Pat. No. 4,388,854, a loading bridge is carried by a parallelogram suspension or linkage and, in a lowered position of the loading bridge, ammunition is received on a magazine and pivoted forward in front of a weapon breech block. Disadvantages of this proposed arrangement resides in the fact that the construction is only suitable for small calibre ammunition, and the ammunition is only movable in a horizontal direction.

A similar parallelogram suspension or linkage is also proposed for free-standing guns in, for example, U.S. Pat. No. 1,304,583; however, as with the aforementioned United States patent the ammunition is only movable in a horizontal direction.

In, for example, commonly-assigned U.S. patent application Ser. No. 083,289, now U.S. Pat. No. 4,823,675, a loading arrangement for tank howitzers is proposed wherein a rotary or revolving magazine within a turning circle of a turret is provided, with the magazine rotating or revolving along two circles concentric to the turret rotation axis and receiving the ammunition in an upright position. The ammunition can be removed from the rotary magazine by a loader pivotable about two axis at right angles to one another between an acceptance or take-over position on the magazine and the loading position in which the ammunition received from the magazine is aligned with a bore axis of the weapon.

Although the last proposed arrangement permits the housing or more ammunition in the rotary magazine, by virtue of the necessary pivoting movements of the loading arm, the loader requires a considerable amount of free space which, in turn, reduces the amount of space for accommodating ammunition.

In a further development of the loading arrangement proposed in the aforementioned United States application, in, for example, commonly-assigned U.S. patent application Ser. No. 141,302, it has been proposed to arrange a further rotary magazine provided with ammunition from outside in a rear or tail of the vehicle behind the turret turning circle, with a transfer mechanism, movable between the rotary magazine and the vehicle tail and the rotary magazine in the turret, enabling the turret magazine to be re-equipped with ammunition by the loader as a function of removal of the ammunition.

The last proposed construction is disadvantageous in that the loader is only suitable for relatively small calibre ammunition and, in particular, only for howitzers but not for large calibre tank guns.

The aim underlying the present invention essentially resides in providing an armoured car of the aforementioned type which enables large calibre ammunition to be brought in a space saving manner from magazines of the vehicle into a loading position without manual transfer or loading being necessary, and, enables the possibility of providing a greater housing for accommodating more ammunition in the car or vehicle than previously accommodated.

In accordance with advantageous features of the present invention, an armoured car is provided having an ammunition magazine concentric to the turret rotation axis, with a loader being positioned by a ring mount located substantially below the weapon breach block on the turret platform. The ring mount includes an axis of rotation coincidental with the axis of rotation of the turret, and a multi-lever guide means is supported on the ring mount and is movable in a vertical plane for raising the loading arm with the upright or vertical ammunition along a steep movement path, and, only toward an end of the steep movement path, the loading arm swings the ammunition into the loading position.

Through arranging the loader on a ring mount it is possible to move up to each of the positions on the magazine arranged concentrically to the rotation axis of the turret regardless of whether a stationary or a rotary magazine is used. As a result of the loader construction in the form of a multilever guide means, the loading arm can effect a space saving movement path and it is possible to take account of the constricted space conditions in a tank turret. Thus, it is possible to construct the guide means in such a way that the loading arm with the ammunition standing upright in the magazine can be raised from this position in a steep movement path and is only swung towards the end of the movement path into the loading position, where the ammunition is aligned with the weapon bore axis. Thus, the ammunition can be brought from a position roughly below the weapon breech block into the loading position, without there being any significant lateral swinging movement.

According to a preferred construction the guide means is located on a sliding table, which is guided on the ring mount and is movable between a starting position for the loading process aligned with the rotation axis of the ring mount and a take-over or acceptance position on the magazine.

This embodiment leads to the further advantage that the loader in the starting position roughly below the weapon can cover a larger lateral path, in order to be able to bridge a corresponding spacing between the rotation axis of the turret and the magazine with the concentric arrangement of the ammunition, with the spacing only being required during the process of accepting ammunition from the magazine.

According to an embodiment of the invention the magazine can be arranged as a turret magazine on the turret platform and receive the ammunition on two concentric circles or pitch circles, with the sliding table being movable between the starting position, and in each case, one acceptance position for the ammunition on one of the two circles.

With the aid of the ring mount it is possible to move up to any angular position and with the sliding table any radial position of the ammunition within the turret magazine, after which the ammunition can be taken up and brought into the loading position. The turret magazine can extend over a large part of the turret platform circumference and can have a stationary construction due to the rotary mounting of the loader.

A further ammunition supply can be formed in that in the vehicle rear or tail behind the turret is arranged a rotary magazine with upright ammunition and the loader with the sliding table can be moved into a rotary magazine reception position close to the turret for receiving ammunition therefrom.

This embodiment makes it possible to move up to a conventional rotary magazine in the vehicle tail directly with the loader, remove the ammunition from the magazine and transfer it either directly into the loading position or, in preferred manner, into the turret magazine. This can in particular take place during firing intervals, whereas, during battle loading, preferably takes place from the turret magazine due to the shorter distance which has to be covered. The inventively constructed loader is consequently not only usable for its actual function of bringing ammunition into the loading position, but also for reequipping the turret magazine with ammunition. For this purpose it is merely necessary for the turret magazine to leave a correspondingly large space by which the loader can pass to the storage magazine in the vehicle tail.

The rotary magazine in the vehicle tail can in principle be constructed in random manner and guided in a random movement path. It only has to pass over a near turret acceptance position so as to permit access by the loader. However, advantageously the rotary magazine has a magazine row arranged concentrically to the turret rotation axis and close to the periphery thereof and in whose vicinity is located the reception position.

This construction makes it possible to move up to more than one acceptance or reception position by rotating the turret. This is recommended, for example, in the case of a turret, whose rear engages by a significant amount over the body on the vehicle tail. By rotating the turret, a hatch located in the vehicle tail can be opened for rearming the tail-side magazine and, at the same time, the turret magazine can be rearmed from the rotary magazine in the vehicle tail.

The inventive construction provides the possibility of in particular storing large calibre and especially also two-part ammunition comprising a separate bullet and propellant charge and to bring same in a mechanized operating sequence into the weapon. In this case the turret magazine on its concentric circles can receive bullets and propellant charges and the rotary magazine in the vehicle tail alternating bullets and propellant charges, which are successively removed during the loading process. Here again it is possible to reequip the turret magazine with difficulty.

In the case of armoured cars of the aforementioned construction, it is known to arrange a rammer which moves the ammunition in the turret behind the weapon, generally in a turret tail or rear projecting rearwards over the turret ring mount. In order to utilize this principle with the inventive loader construction, the arrangement is such that the loading arm is in the loading position between the rear end of the weapon and the rammer, so that the rammer can move the ammunition received from the loading arm into the weapon.

If, as is known per se, a loading magazine with an ammunition rammer and a loading position aligned with the weapon bore axis is arranged in the turret behind the weapon, then it is inventively provided that the loading arm is arranged in the loading position between the weapon and the loading magazine and ammunition taken up by the loading arm can be transported by the rammer either directly into the weapon, or into the loading magazine loading position, or from the magazine via the loading arm into the weapon.

In a very simple embodiment the loading magazine is constructed as a single loading tube. This construction is particularly advantageous in the case of split ammunition, in that the loader takes a propellant charge from the turret magazine in a first working cycle, raises it into the loading position and, subsequently, by the rammer, is retracted into the loading tube. In a second loading cycle the loader takes a bullet from the turret magazine and brings the bullet into the loading position, where the bullet and the propellant charge are arranged successively. The rammer can then introduce both bullet and propellant charge into the weapon.

Instead of this, it is also possible to construct the loading magazine as a revolver with several ammunition receptacles, which by means of a rotary drive can be successively brought into the loading position.

The revolver can be filled with cartridged ammunition. As it is positioned directly behind the weapon, as a result of the short paths covered a high firing rate can be achieved. When the revolver is empty, it can be rearmed by the loader. However, it is also possible to alternately charge the revolver with propellant charges and bullets and to introduce same in the order bullet/-propellant charge into the weapon by the rammer. It is also possible to only equip the revolver with propellant charges and to bring the bullets into the loading position with the loading arm, so that also in the case of two-part, large calibre ammunition a high firing rate is achieved.

According to a further advantageous construction of the present invention the loading magazine has an ejector position or can be brought into an ejector position and, in the ejector position, non-ignited ammunition retracted from the weapon by the rammer can be ejected from the turret.

If the loading magazine is a single loading tube, it can be pivoted out of the loading position into the ejector position, so as to eject from the turret the unignited propellant charge. However, if the loading magazine is constructed as a revolver, then it only has to be rotated into the ejector position with the retracted, unignited propellant charge.

Advantageously the loader is movable by the ring mount and/or sliding table into a position, where the loading arm is positioned alongside the weapon. The loader is brought into this position before firing, so as to free the space behind the weapon for the recoil of the latter during each elevation.

According to another preferred construction the guide means is constructed as a five-joint lever means, whose base is formed by the sliding table and whose connecting lever is formed by the loading arm and whose fifth joint is provided on the rear guide lever with respect to the weapon which is constructed from two arms connected by the joint. This construction permits a steep movement path of the loading arm from the vertical position into the loading position, in that the front guide raises the leading end of the loading arm in a swinging or pivoting movement, while the two-arm, rear guide initially performs a raising movement, so that the trailing end of the loading arm is initially raised substantially vertically and only with increasing erecting of the two rear guide arms is it pivoted into the loading position towards the end of the movement. The weapon is brought into an indexing position with limited elevation for the loading process.

In order to be able to do with a single drive despite the construction as a five-joint means, according to a further advantageous embodiment the front guide with respect to the weapon is connected by drive levers to the lower arm of the rear guide and the last guide is coupled to a drive. This construction offers the possibility to construct the drive for the guide means as a linear drive pivotably mounted on the sliding table.

The loading arm of the loader must essentially fulfill two functions, namely, that of reliably gripping the ammunition, optionally also ammunition of different calibres and also to exactly place the ammunition in the loading position. It therefore comprises a pitch cylindrical shell with a movable bottom and at least one pair of grippers supplementing the shell and which are movable between a clamping position fixing the ammunition and a position releasing the same. A number of constructional developments are conceivable in connection with this loading arm construction.

The case ends ejected during the counter-recoil of the weapon are generally collected by a case collector fitted to the weapon. This case collector, which extends rearwards from the breech block, would be in the way in the loading process by the inventively constructed loader. Thus, according to another feature of the invention the case collector is constructed in basket-like manner with a bottom which drops rearwards from the trailing edge of the weapon breech plate and has a collecting plate extending the same to below the breech plate and that the case collector can be pivoted from its operating position by a pivot arm mounted on the weapon and driven from there into a position above the weapon bore axis which frees the loading position and during the pivoting movement the collector plate can be swung into the basket-like case collector.

Due the pivotable arrangement of the case collector, it is possible to pivot the same into a position above the weapon bearing after firing, so that the loader with the ammunition received by it can be introduced into the loading position without encountering any obstacle. The case collector should extend to below the weapon breech plate, so as to be also able to collect poorly ejected case ends. This takes place with the collecting plate engaging below the breech plate through its pivotable mounting on the case collector, in that on swinging up the case collector it is pivoted into the same, so that the case ends which only drop onto the collector plate still slide into the basket-like part of the case collector.

The reliable collection of the case ends is also assisted by the further measure that the collecting plate has on its leading end an upright recoil guard, which can be pivoted rearwards during the recoil of the weapon by the breech plate. This recoil guard, which can be under spring tension and can itself become upright, is pivoted rearwards by the breech plate during the weapon recoil. This ensures a reliable completion of case collection below the breech plate.

BRIEF DESCRIPTION OF THE DRAWINGS

The invention is described in greater detail hereinafter relative to non-limitative embodiments and the attached drawings, wherein.

DETAILED DESCRIPTION

Figure 1:
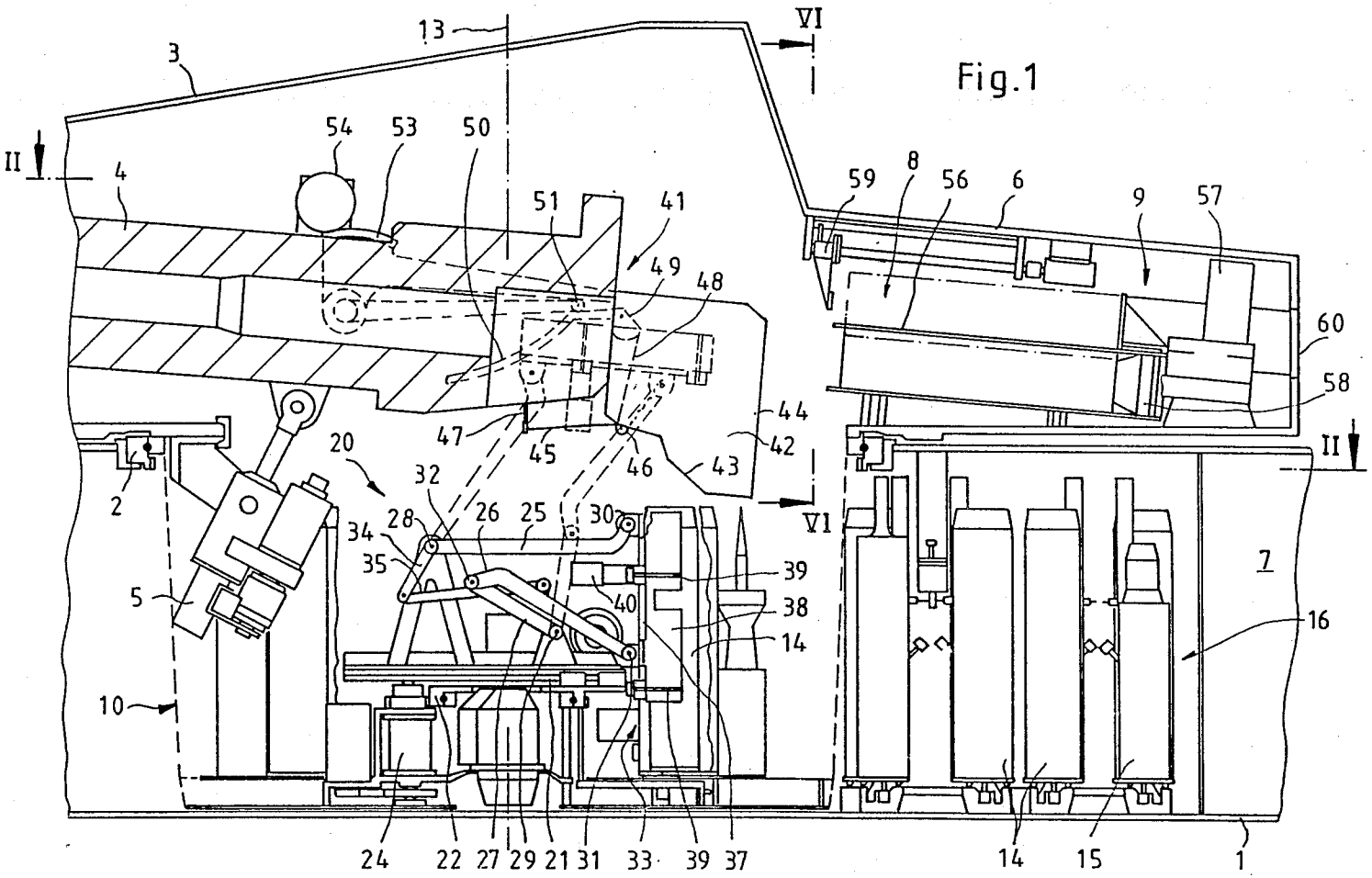
FIG. 1 is a diagrammatical longitudinal cross-sectional view through a portion of a first embodiment of an armoured vehicle constructed in accordance with the present invention.
Figure 2:
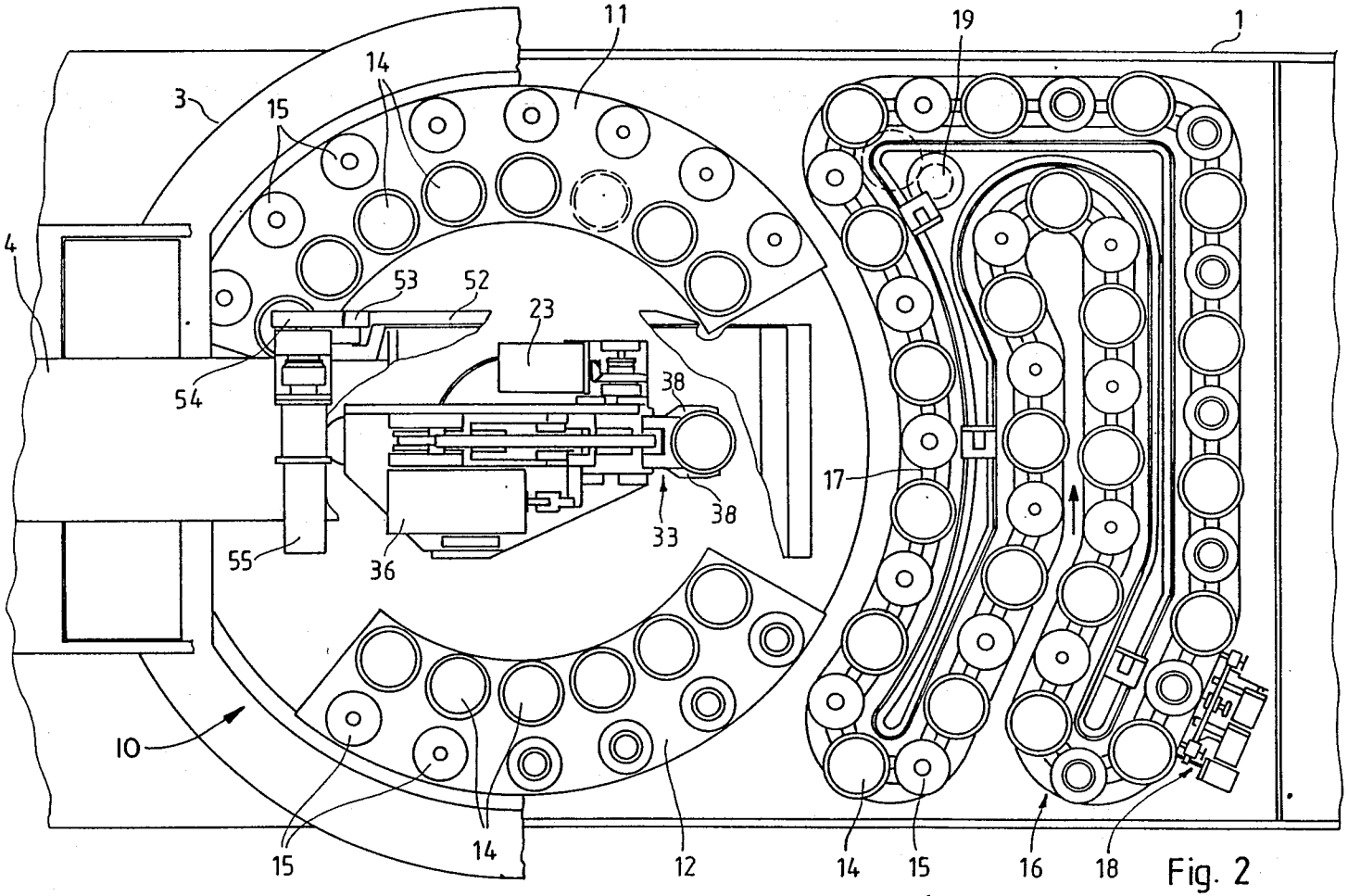
FIG. 2 is a cross-sectional view taken along the line II—II in FIG. 1.

Referring now to the drawings wherein like reference numerals are used throughout the various views to designate like parts and, more particularly, to FIGS. 1 and 2, according to these figures, an armoured vehicle or car includes a body 1 having a turret 3 supported thereon by a pivot bearing 2, with a weapon 4 being mounted in the turret 3, and with an elevating device 5 acting on the weapon 4. The turret 3 includes a tail part 6 engaging rearwardly over a cover of the body 1 of a vehicle tail or rear 7 and is used for housing a loading magazine generally designated by the reference numeral 8 and a rammer generally designated by the reference numeral 9.

As shown in FIG. 2, a fixed turret magazine is located on the platform generally designated by the reference numeral 10 of turret 3 and in the represented embodiment comprises two pitch cylindrical magazines 11, 12 and on in each case two circles concentric to the rotation axis (FIG. 1) 13 of the turret 3 receives in an upright position the ammunition which, in the represented embodiment, comprises propellant charges 14 and bullets 15. In the embodiment according to FIGS. 1 and 2, a rotary magazine generally designated by the reference numeral 16 is also arranged in the vehicle tail 7 and runs in the form of several strands in the rear part of the vehicle body 1. It has a turret-near magazine strand 17, which is concentric to the turret rotation axis 13. Propellant charges 14 and bullets 15 are alternately arranged in the rotary magazine. By a loading device generally designated by the reference numeral 18, the rotary magazine can be loaded from the outside by a hatch in the body cover. The loading device 19 is not described in detail here, because it does not form part of the invention. The rotary magazine 16 is moved by a drive 19.

As shown in FIG. 1, a loader generally designated by the reference numeral 20 is disposed within the turret 3 below the bearing of the weapon 4, with the loader 20 being located on a sliding table 21. The sliding table 21 is guided or runs along longitudinal guides of a ring mount 22 supported on the turret platform 10, with the sliding table 21 being driven by a drive 23 (FIG. 2) and the ring 22 being driven by a rotary drive 24 (FIG. 1).

Loader 20 essentially comprises a multilever guide means in the form of a five-joint means. It has a front guide 25 and a rear guide formed from two arms 26, 27. The five joints are designated 28, 29, 30, 31 and 32, joints 28 and 29 being arranged on the sliding table 21 forming the base of the five-joint means, while joints 30, 31 are connected by a loading arm generally designated by the reference numeral 33 forming the connecting lever of the five-joint means. The front guide 25 is extended over and beyond its base joint 28 downwards to an arm 34, on which is mounted a driving connecting rod 35, which also engages in an articulated manner on the lower arm 27 of the rear guide. For placing upright the five-joint means shown in the starting position in FIG. 1 a linear drive 36 (FIG. 2) is provided, which is mounted on a horizontal axis on the sliding table 21.

Loading arm 33 has a rigid, pitch cylindrical loading shell 37 with an arc angle smaller than 180°, which is connected by joints 30, 31 to guides 25 or 26, 27. The loading shell 37 is supplemented by two grippers 38, which engage around in their clamping position the ammunition 14, 15 on an arc angle of more than 180°. Both grippers 38 are connected by guide means 39 to a common drive 40, which moves the grippers 38 out of the clamping position into an open position and vice versa.

A case collector 42, having a basket-like construction and a downwardly stepped falling bottom 43 and rear wall 44 is associated with the weapon 4 in a vicinity of a breach block generally designated by the reference numeral 41. On the leading edge of the bottom 43 a chain wheel 46 is mounted on a collecting plate 45 and is under the action of a tension spring urging the collecting plate 45 into the position shown in FIG. 1. In this position the collecting plate 45 engages below the breech plate of the weapon 4. The flush termination is provided by a recoil guard 47, which can be brought into the upright position of FIG. 1 by a spring (not shown), but is reversed rearwards by the breech plate during the weapon recoil. A chain 48, suspended on a chain guide 49 engages on the chain wheel 46. Chain guide 49 is part of a curved control lever 50, which is guided on a stop 51 fixed to weapon 4. The complete case collector 42 is fixed to a rigid pivot arm 52, which is pivotable by a toothed segment 53 via a spur wheel 54 of a rotary drive 55. Thus, the case collector 42 can be raised out of the operating position (FIG. 1) collecting the ejected case ends into an inoperative position (FIG. 4), in which the weapon 4 can be loaded. During this pivoting movement, which is followed by the control lever 50, the collecting plate 45 is pivoted by the chain 48 into the basket-like case collector 42, so that the case ends which have only been ejected onto the collecting plate 45 slide back into the case collector 42.

The operation and certain operational possibilities will now be described. FIG. 1 shows loader 20 in its starting position, in which the guide means 25, 26, 27 is in its collapsed, lowest position and the loading arm 33 is arranged vertically alongside sliding table 21. From this position, by rotating the ring mount 22 and longitudinal displacement of sliding table 21, the loading arm 33 can reach any position of the propellant charges 14 or bullets 15 in the turret magazine 11, 12 (FIG. 2), remove a propellant charge 14 or a bullet 15 and, after moving back into the position according to FIG. 1 by bringing the guide means 25, 26, 27 into the raised position represented in dot-dash lines, can bring same into the loading position, where the ammunition is aligned with the bore axis of weapon 4.

Instead of this, the loading arm 33 can be extended so far rearwards out of the starting position shown in FIG. 1 by the sliding table 21, that the loading arm reaches a position aligned with the weapon on the turret-near magazine strand 17 and can take up ammunition there by the gripper 38. This ammunition can then be transferred by the loading arm 33 either into the turret magazine 11, 12, or directly into the loading position (FIG. 1). If the turret magazine 11, 12 is empty, then the positions for bullets 15 and propellant charges 14 are successively filled with the bullets or propellant charges in the rotary magazine 16. This rearming of the turret magazine 11, 12 preferably takes place in the position shown in FIG. 2, but can also take place in the so-called 11 o'clock position of the weapon 4, in which the sliding table 21 is close to the rotary magazine drive 19. In this position the tail part 6 of turret 3 frees the cover of body 1 in the vicinity of the vehicle tail 7 in such a way that by the loading device 18, the rotary magazine 16 can be refilled with ammunition through a not shown hatch.

Figure 3:
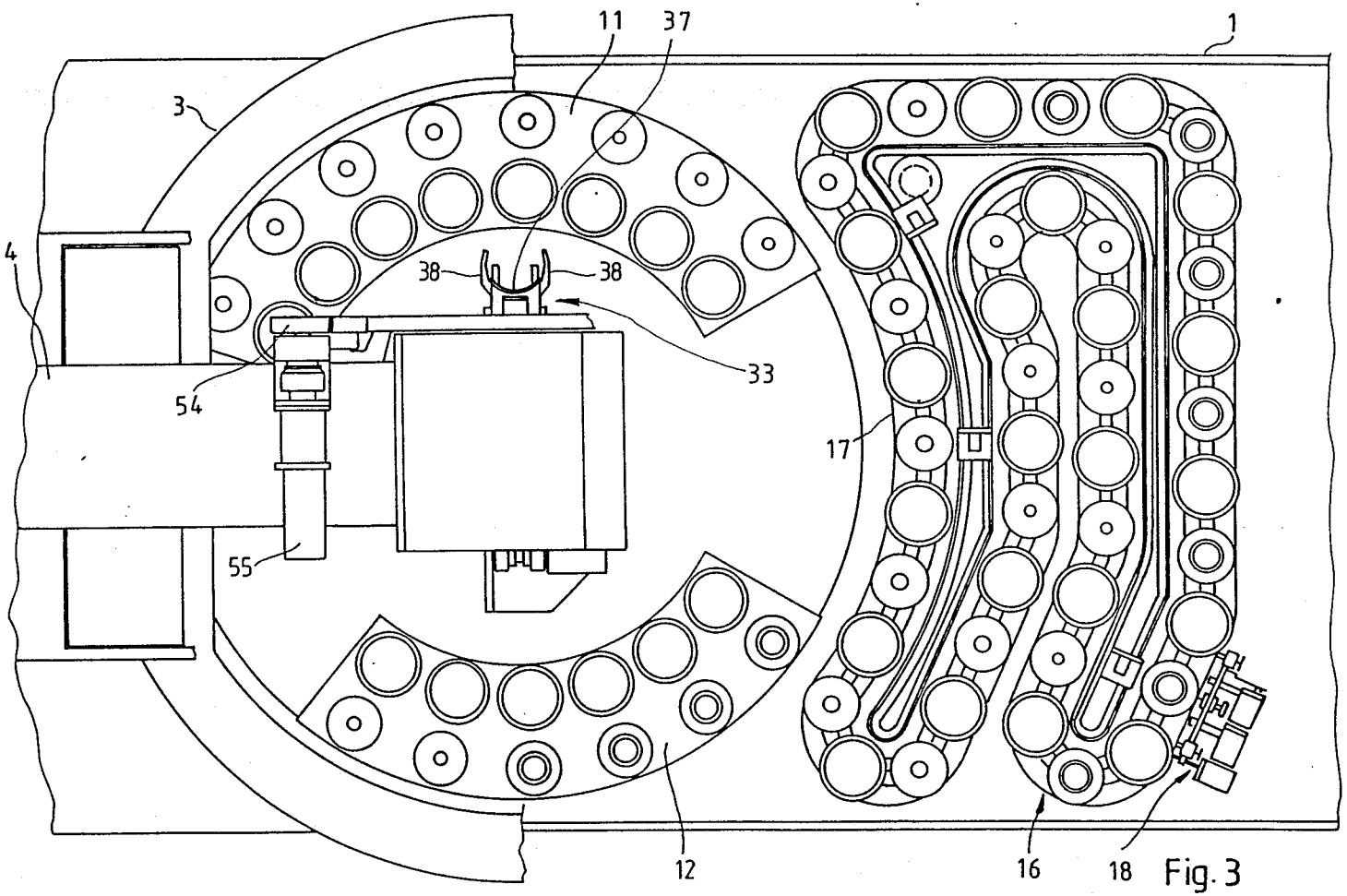
FIG. 3 is a plan view corresponding to FIG. 2 with the loader in an inoperative position.

The loading arm 33 can finally be moved into an inoperative position alongside the weapon shown in FIG. 3 and this is normally assumed by the loading arm 33 on firing weapon 4.

If, as in the embodiment of FIGS. 1, 2 and 4, 5, large calibre, two-part ammunition is used, then the loading of bullets and propellant charges can take place simultaneously with the aid of the loading magazine 8. In this embodiment the loading magazine 8 comprises a single loading tube 56 positioned in the tail part 6 of the turret 3 aligned with the bore axis of weapon 4. In this case, by the loading arm 33 initially a propellant charge 14 is removed from the turret magazine 11, 12 and raised into the loading position. After releasing gripper 38 (FIG. 4), the propellant charge 14 is retracted by the advanced rammer piece 58 into the loading tube 56 by the rammer 9, which is constructed in this case as a chain rammer with a drive 57 and a rammer piece 58. The loading arm 33 then again moves up to the turret magazine 11, 12, from where it removes a bullet 15, brings the same again into the loading position (FIG. 5) directly upstream of the propellant charge 14. The bullet 15 and propellant charge 14 are then moved by the rammer 9 into the weapon 4.

Prior to the start of the loading process, the case collector 42 is raised by swinging up the swinging arm 52 and as a result the collecting plate 45 is pivoted inwards into the basket-like case collector. Following the loading process, the case collector 42 is again pivoted downwards and simultaneously the collector plate 45 is swung out by the tension spring in the forward direction to below the weapon breech plate.

Figure 4:
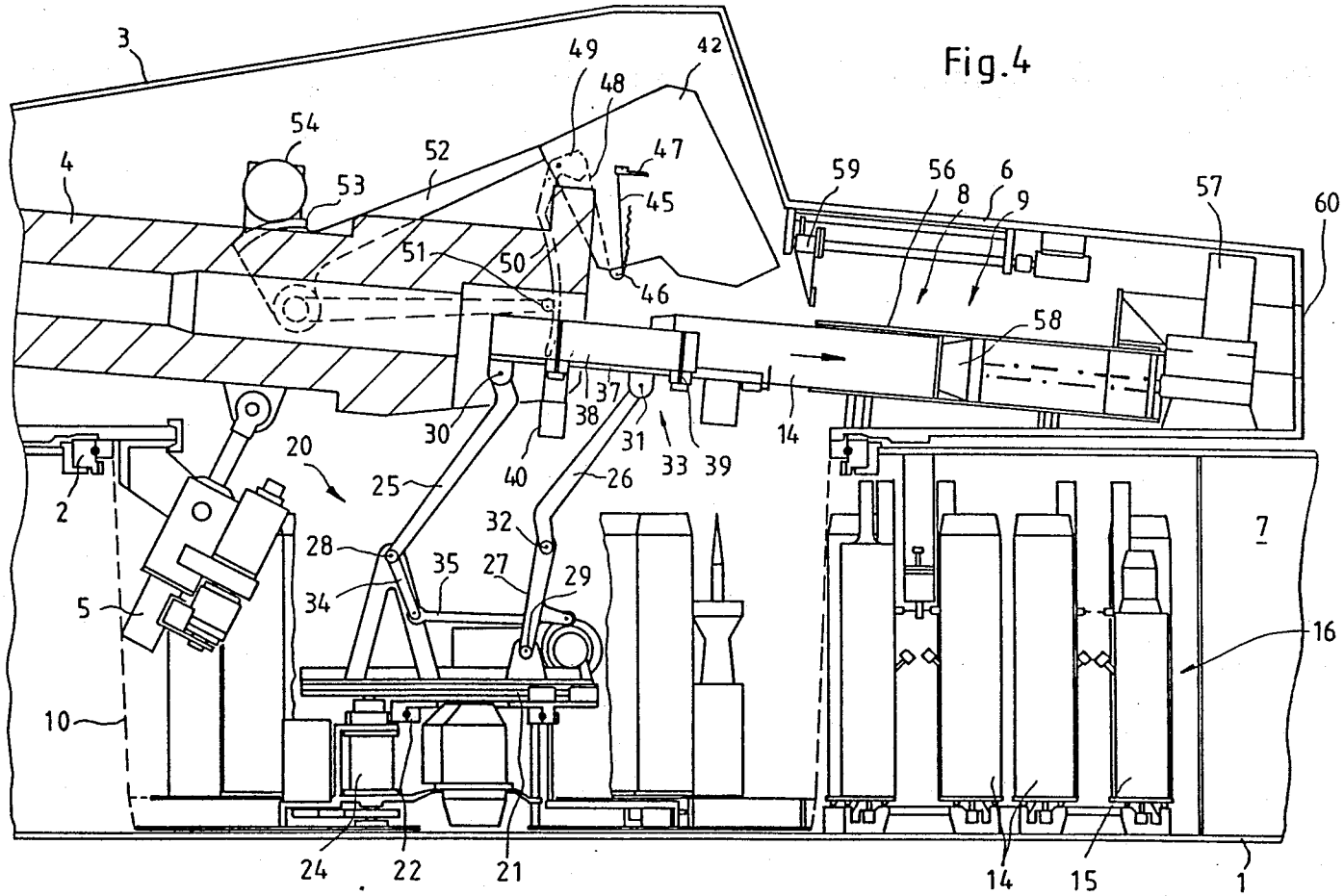
FIG. 4 is a diagrammatical longitudinal cross-sectional view corresponding to FIG. 1 during a loading process with a loading magazine.

As can be gathered from FIG. 1, 4 and 5, above the loading tube 56 is arranged a driven ejector 59, which will now be described in conjuction with FIG. 6. On the tail part 6 of turret 3 is provided an ejector opening 60, in front of which can be pivoted the loading tube 56, which is mounted at 61. In this position ejector 59 can act on ammunition located in the loading tube 56 and eject same rearwards via ejector opening 60. This makes it possible to discharge through ejector opening 60 failed shells drawn back from weapon 4 into loading tube 56 by means of the rammer piece 58, following the pivoting of the loading tube.

Figure 5:
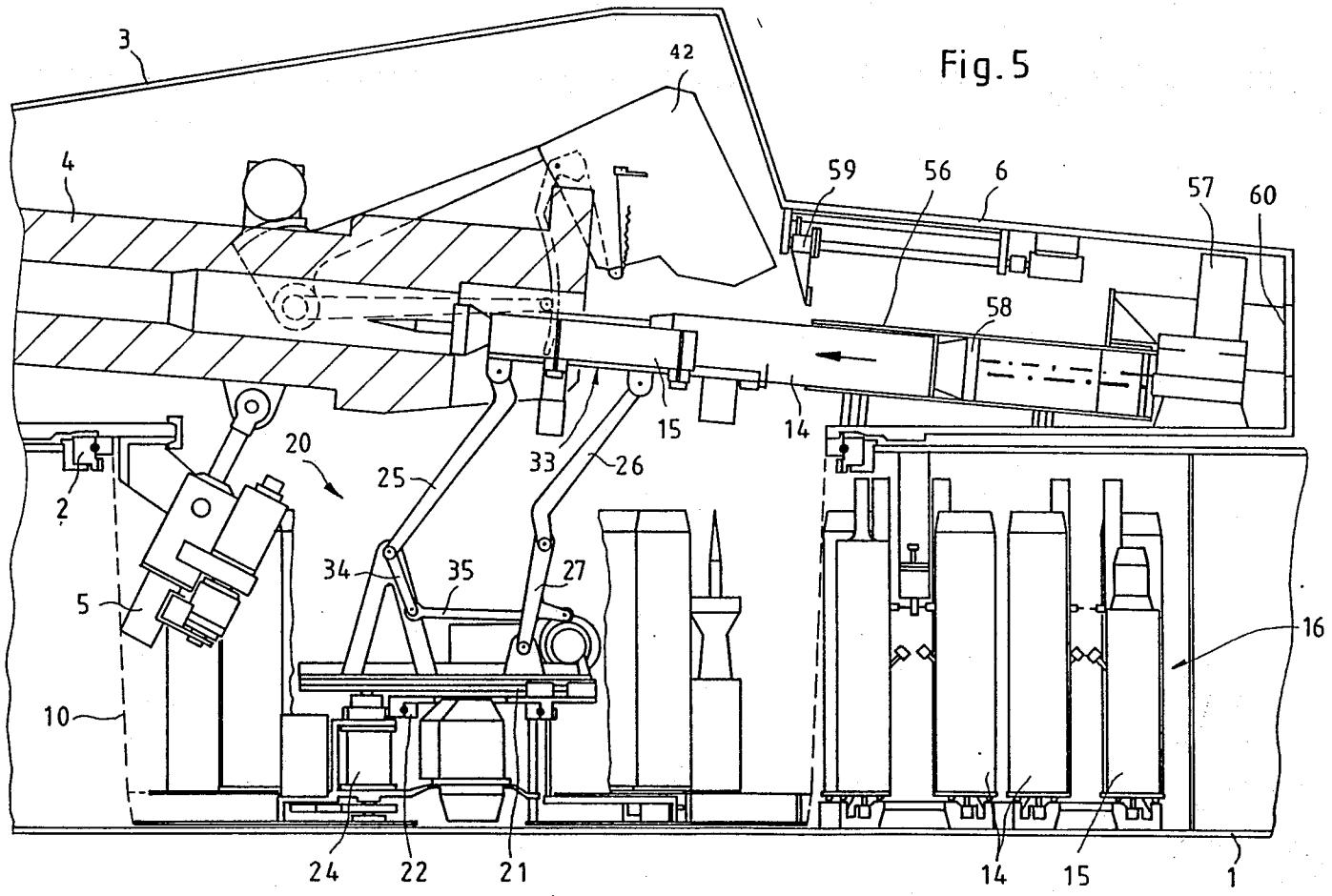
FIG. 5 is a longitudinal cross-sectional view corresponding to FIG. 4 in a further phase of the loading process.
Figure 6:
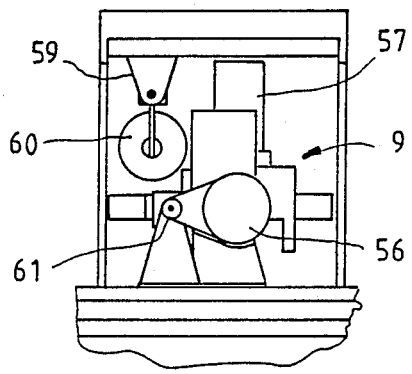
FIG. 6 is a cross-sectional view taken along the line VI—VI in FIG. 1 in a different loading magazine operating position.
Figure 9:
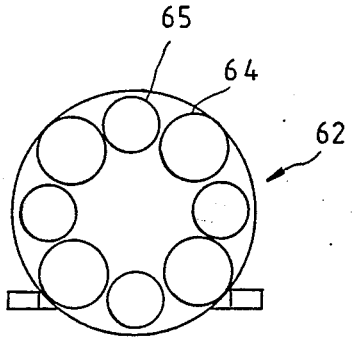
FIG. 9 is a cross-sectional view taken along the line IX—IX in FIG. 8.
Figure 7:
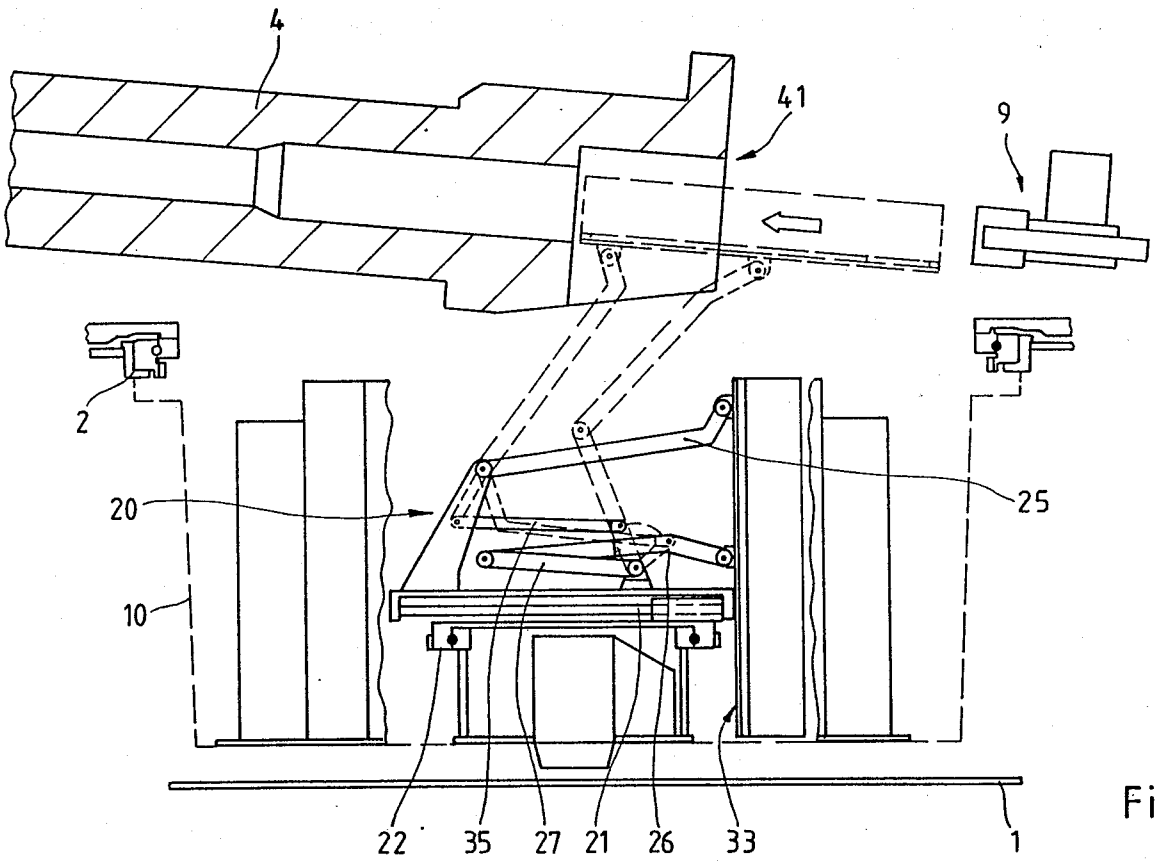
FIG. 7 is a partially schematic cross-sectional view similar to FIG. 1 of another embodiment of an armoured vehicle constructed in accordance with the present invention.
Figure 8:
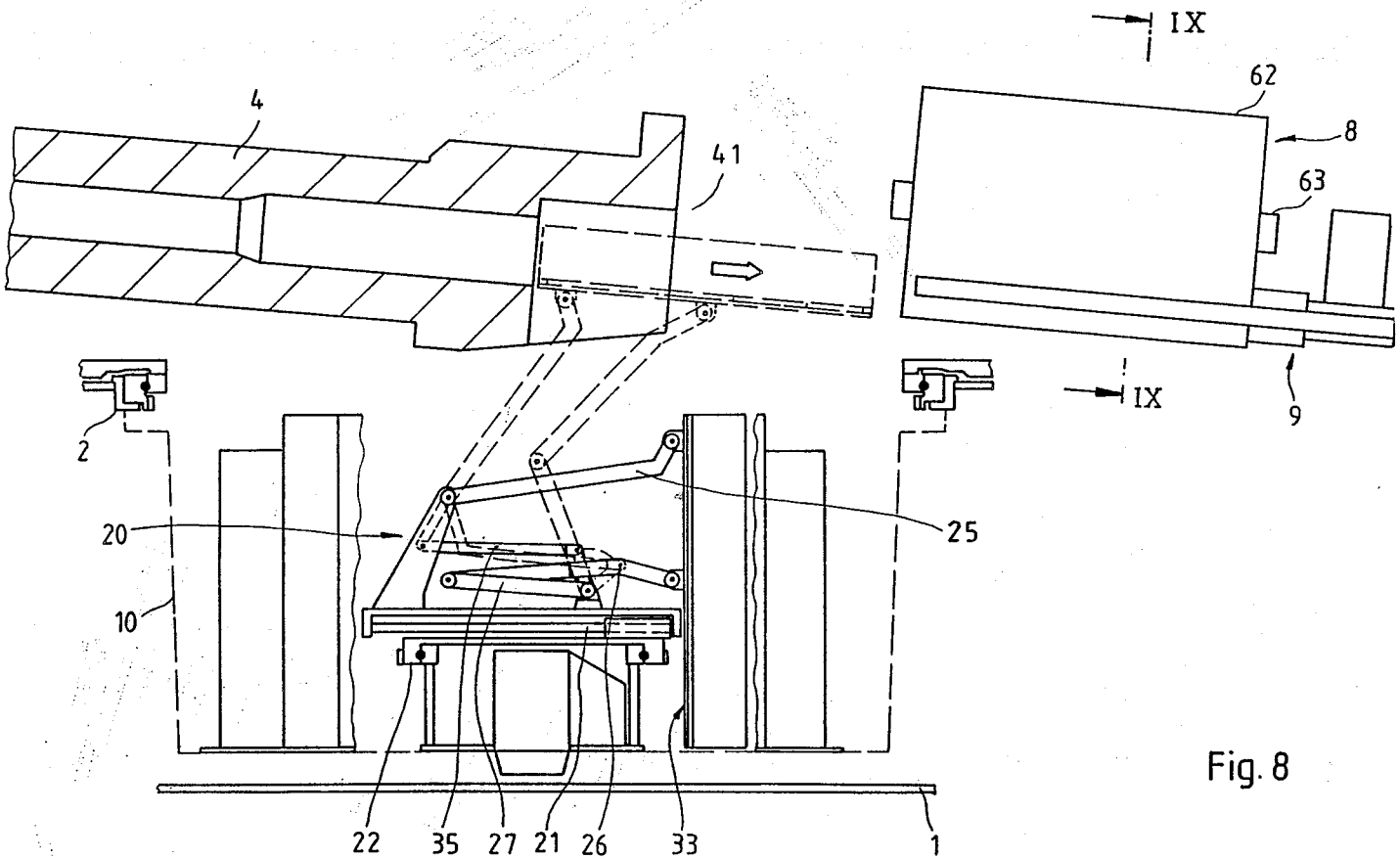
FIG. 8 is a schematic partial cross-sectional view of yet another embodiment of an armoured vehicle constructed in accordance with the present invention.

A loading magazine as shown in FIGS. 1, 5 and 6 is mainly used for increasing the firing speed, but is not vital. Thus, the turret may only contain a rammer 9, as shown in FIG. 7. In this case by the loading arm 33 cartridged or also two-part ammunition (in this case in the sequence bullet/propellant charge) is raised into the loading position and directly inserted in the weapon by rammer 9. The loading magazine can also have several ammunition receptacles, as is shown in the embodiments of FIGS. 8 and 9 in the form of a revolver generally designated by the reference numeral 62, which can be rotated about an axis 63 (FIG. 8) and, as can be gathered from FIG. 9, has several receptacles 64, 65 on a concentric circle. In this case, the receptacles 64, 65 can have different diameters in alternating arrangement in order to alternately receive propellant charges and bullets. Instead of this, the receptacles in the revolver 62 may only be constructed for propellant charges and the bullets are brought into the loading position with the loading arm. With the revolver 62 is once again associated a rammer 9 with drive 57, by which the ammunition can be transported from the revolver 62 into the weapon 4 in an indexing position coinciding with the weapon 4. The revolver 62 can naturally also be combined with an ejector 59, much as in the embodiment according to FIGS. 1, 4 and 5, in that one of the rotary positions of revolver 62 is aligned with the ejector opening 60. This construction makes it possible to load several bullets in the shortest possible time intervals. If the revolver 62 is empty, it can be rearmed by the loader 20 from the turret magazine 11, 12 and/or the rotary magazine 16.

We claim:

1. Armoured car with a rotatable turret, a weapon mounted in the turret, a magazine housed in the armoured car and receiving large calibre ammunition in an upright position in an arrangement concentric to a rotational axis of the turret, and a loader having a loading arm engaging with the ammunition in the magazine and raising the same into a loading position aligned with a bore axis of the weapon, wherein the loader is arranged on a rotatable ring mount positioned below a weapon breach block on a turret platform, said ring mount having an axis of rotation coincidental with the rotational axis of the turret, and wherein a multilever guide means is supported on the ring mount and is movable in a vertical plane for raising the loading arm of the loader with the upright ammunition along a steep movement path and only pivots the loading arm into the loading position towards and end of the steep movement path.

2. Armoured car according to claim 1, wherein the guide means is located on a sliding table guided on the ring mount, said sliding table being movable between a starting position for a loading process and a take-over position.

3. Armoured car according to claim 2, wherein the magazine is a turret magazine arranged on a turret platform for receiving the ammunition on two concentric circles or pitch circles, and wherein the sliding table is movable between the starting position and in each case one take-over position for the ammunition on one of the two circles.

4. Armoured car according to one of claims 1, 2, or 3, wherein a rammer means is arranged in the turret behind the weapon for moving the ammunition into the weapon, and wherein the loading arm is located in the loading position between a rear end of the weapon and the rammer means.

5. An armoured car according to one of claims 1, 2 or 3, wherein the loading magazine includes an ejector position or can be brought into an ejector position in which unignited ammunition moved back out of the weapons by a rammer means can be ejected from the turret.

6. An armoured car according to one of claims 1, 2 or 3, wherein the loader is adapted to be moved by at least one of the ring mount and the sliding table into a position where the loading arm is positioned alongside the weapon.

7. An armoured car according to one of claims 1, 2, or 3, wherein the loading arm comprises a pitch cylindrical shell and at least one pair of grippers supplementing the cylindrical shell, said at least one pair of grippers being adapted to be moved between a clamping position fixing the ammunition and a position releasing the same.

8. An armoured car according to one of claims 1, 2, or 3, wherein a loading magazine with a rammer means for the ammunition is provided in the turret behind the weapon, said loading magazine having a loading position aligned with the bore axis of the weapon, and wherein said loading arm is located in a loading position between the weapon and the loading magazine, said loading arm being adapted to take up the ammunition and transport the ammunition by the rammer means either into the weapon or into the loading position of the loading magazine or from the loading magazine into the weapon.

9. An armoured car according to claim 8, wherein the loading magazine includes a single loading tube.

10. An armoured car according to claim 8, wherein the loading magazine includes a revolver means with a plurality of ammunition receptacles adapted to successively be brought into the loading position by a rotary drive means.

11. An armoured car according to one of claims 1, 2 or 3, wherein a case collector means is arranged on the weapon for collecting ejected ammunition case ends, said case collector means being constructed in a basket-like manner including a bottom falling approximately rearwardly from a trailing edge of a breach plate of the weapon and a collecting plate extending the same to below the breach plate, and wherein said case collector means is pivotable from an operating position by a pivot arm mounted on the weapon and driven therefrom into a position freeing the loading position above the bore axis of the weapon, with the collector plate being swung into the case collector means during the pivoting movement.

12. An armoured car according to claim 11, wherein the collector plate is mounted on a weapon-near leading edge of the bottom of the case collector means and, in a forcibly coupled manner with the pivoting movement, can be swung into the case collector means.

13. An armoured car according to claim 12, wherein the collector plate is provided on the leading edge with an upright recoil guard pivotable rearwardly by the breach plate during a recoil of the weapon.

14. Armoured car according to one of claims 1 to 3, wherein a rotary magazine with upright ammunition is arranged at a vehicle tail behind the turret, and wherein the loader with the sliding table is movable into a near-turret reception position of the rotary magazine for receiving ammunition therefrom.

15. Armoured car according to claim 14, wherein the rotary magazine includes a magazine strand concentric to the rotational axis of the turret and arranged in a vicinity of a periphery of the turret, and wherein a range of the magazine strand is located in the reception position of the rotary magazine.

16. Armoured car according to claim 15, wherein the rotary magazine and the loader have a plurality of common take-over positions.

17. Armoured car according to claim 16, wherein the rotary magazine alternately accommodates bullets and propellant charges, and wherein, in the turret magazine, bullets are arranged on one of the two circles and propellant charges on the other.

18. Armoured car according to claim 17, wherein a rammer means is arranged in the turret behind the weapon for moving the ammunition into the weapon, and wherein the loading arm is located in the loading position between a rear end of the weapon and the rammer means.

19. An armoured car according to one of claims 2 or 3, wherein the multi-levered guide means includes a five-joint lever means, said sliding table forms a base of the five-joint lever means, the five-joint lever means includes a connecting lever formed by the loading arm, and wherein a fifth joint of the five-joint lever means is provided on a rear guide lever with respect to the weapon, said rear guide lever comprising two arms connected by the fifth joint.

20. An armoured car according to claim 19, wherein a front guide lever of the five-joint lever means with respect to the weapon is connected by drive levers to a lower arm of the two arms of the rear guide lever, and said rear guide lever is coupled to a drive means.

21. An armoured car according to claim 20, wherein said drive means includes a linear drive pivotably mounted on the sliding table.

22. Armoured car according to claim 3 wherein a loading magazine with a rammer means for the ammunition is provided in the turret behind the weapon, said loading magazine having a loading position aligned with the bore axis of the weapon, and wherein said loading arm is located in the loading position between the weapon and the loading magazine, said loading arm being adapted to take up the ammunition and transport the ammunition by the rammer means either into the weapon or into the loading position of the loading magazine or from the loading magazine into the weapon.

23. Armoured car according to claim 22, wherein the loading magazine includes a single loading tube.

24. Armoured car according to claim 22, wherein the loading magazine includes a revolver means with a plurality of ammunition receptacles adapted to be successfully brought into the loading position by a rotary drive means.

25. Armoured car according to claim 22, wherein the loading magazine includes an ejector position or can be brought into an ejector position in which unignited ammunition moved back out of the weapon by the rammer means can be ejected from the turret.

26. Armoured car according to claim 25, wherein the loader is adapted to be moved by at least one of the ring mount and the sliding table into a position where the loading arm is positioned alongside the weapon.

27. Armoured car according to claim 26, wherein the multi-levered guide means includes a five-joint lever means, said sliding table forms a base of the five-joint lever means, the five-joint lever means includes a connecting lever formed by the loading arm, and wherein a fifth joint of the five-joint lever means is provided on a rear guide lever with respect to the weapon, said rear guide lever comprising two arms connected by the fifth joint.

28. Armoured car according to claim 27, wherein a front guide lever of the five joint lever means with respect to the weapon is connected by drive levers to a lower of the two arms of the rear guide lever, and said rear guide lever is coupled to a drive means.

29. Armoured car according to claim 28, wherein said drive means includes a linear drive pivotably mounted on the sliding table.

30. Armoured car according to claim 29, wherein the loading arm and at least one pair of grippers supplementing the cylindrical shell, said at least one pair of grippers being adapted to be moved between a clamping position fixing the ammunition and a position releasing the same.

31. Armoured car according to claim 30, wherein a case collector means is arranged on the weapon for collecting ejected ammunition case ends, said case collector means being constructed in a basket-like manner including a bottom falling approximately rearwardly from a trailing edge of a breach plate of the weapon and a collecting plate extending the same to below the breach plate, and wherein said case collector means is pivotable from an operating position by a pivot arm mounted on the weapon and driven therefrom into a position freeing the loading position above the bore axis of the weapon, with the collector plate being swung into the case collector means during the pivoting movement.

32. Armoured car according to claim 31, wherein the collector plate is mounted on a weapon-near leading edge of the bottom of the case collector means and, in a forcibly coupled manner with the pivoting movement, can be swung into the case collector means.

33. Armoured car according to claim 32, wherein the collector plate is provided on a leading edge with an upright recoil guard pivotable by the breach plate during a recoil of the weapon.

* * * * *